US005205768A

United States Patent [19]

Pollack

[11] Patent Number: 5,205,768

[45] Date of Patent: Apr. 27, 1993

[54] MULTIPLE FLUID SWIVEL ARRANGEMENT

[75] Inventor: Jack Pollack, Camarillo, Calif.

[73] Assignee: Imodco, Inc., Calabasas Hills, Calif.

[21] Appl. No.: 739,608

[22] Filed: Aug. 1, 1991

[51] Int. Cl.[5] ..... B63B 21/52

[52] U.S. Cl. ..... 441/5; 114/230; 285/136

[58] Field of Search ..... 441/3, 4, 5; 114/230; 141/250, 284, 387; 137/236.1; 285/136, 168, 190, 282

[56] References Cited

U.S. PATENT DOCUMENTS

| | | | |
|---|---|---|---|
| 3,648,311 | 3/1972 | Voss . | |
| 3,698,433 | 10/1972 | Dobler et al. . | |
| 4,052,090 | 10/1977 | Stafford . | |
| 4,126,336 | 11/1978 | Ortloff et al. . | |
| 4,174,127 | 11/1979 | Carn et al. . | |
| 4,183,559 | 1/1980 | Staffird et al. . | |
| 4,270,611 | 6/1981 | Arnaudeau et al. . | |
| 4,570,978 | 2/1986 | Arendt . | |
| 4,602,586 | 7/1986 | Ortloff | 441/5 |
| 4,639,228 | 1/1987 | Bulow | 441/5 |
| 4,647,077 | 3/1987 | Ethridge et al. . | |
| 4,662,657 | 5/1987 | Harvey et al. . | |
| 4,669,758 | 6/1987 | Feller et al. . | |
| 4,756,559 | 7/1988 | Shimada et al. . | |
| 4,759,573 | 7/1988 | Delamare . | |
| 4,915,416 | 4/1990 | Barrett | 285/119 |
| 5,113,778 | 5/1992 | Paasche et al. | 441/5 |

FOREIGN PATENT DOCUMENTS

| | | | |
|---|---|---|---|
| 2131200 | 1/1972 | Fed. Rep. of Germany | 441/5 |
| 882683 | 6/1988 | Norway . | |
| 884282 | 3/1990 | Norway . | |
| 885306 | 5/1990 | Norway . | |

OTHER PUBLICATIONS

Offshore Technology Conference, by Haslum et al, May 1–4, 1989, "Multipass Swivels Based on Flexible Pipes".

*Primary Examiner*—Jesus D. Sotelo
*Assistant Examiner*—Stephen P. Avila
*Attorney, Agent, or Firm*—Arthur Freilich; Robert D. Hornbaker; Leon D. Rosen

[57] ABSTRACT

A multiple fluid swivel arrangement is described, for connecting stationary undersea pipes to rotatable pipes on a weathervaning ship, which provides ready access to each of the fluid swivels and which minimizes the diameters of the fluid swivels and their seals and other parts. Each of the multiple fluid swivels, except for the uppermost one, includes a largely horizontal arm (40A, FIG. 2) with an inner end (38) that can pivot about a largely vertical axis (32) on a fluid swivel body (33) that is connected to a stationary pipe (12A) extending to a deep underwater location. The outer end (42) of the arm is detachably connected to one of a plurality of couplings (44A, 46A) mounted on the ship. As the ship weathervanes and the arm approaches one of the vertical stationary pipes (12B), the outer end of the arm is disconnected from a coupling (44A), the arm is pivoted until its outer end lies adjacent to a second coupling (46A), and the outer end of the arm is attached to the second coupling.

18 Claims, 6 Drawing Sheets

FIG. 1
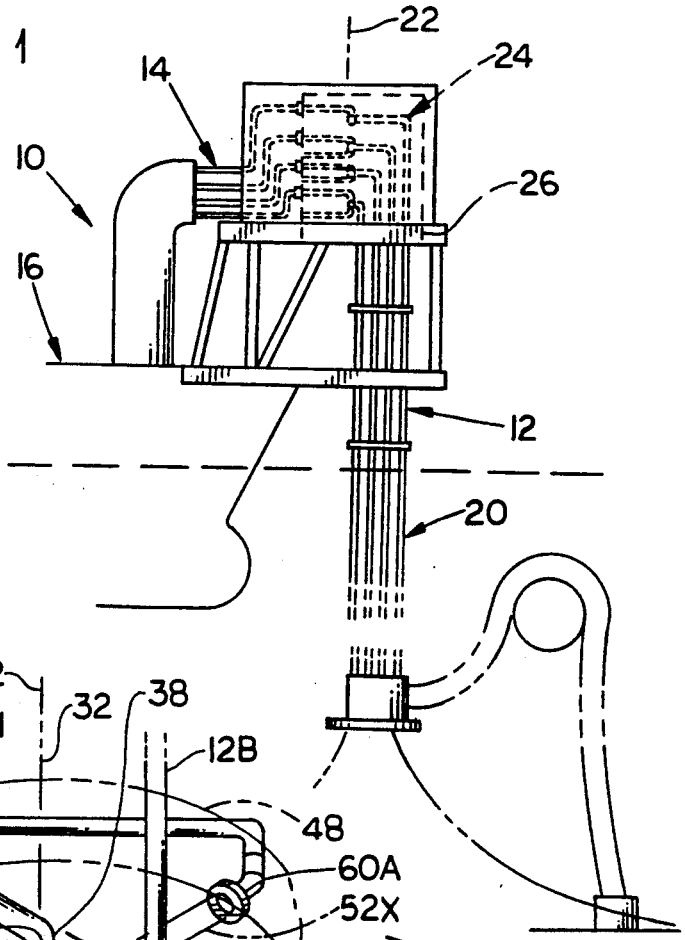
FIG. 2
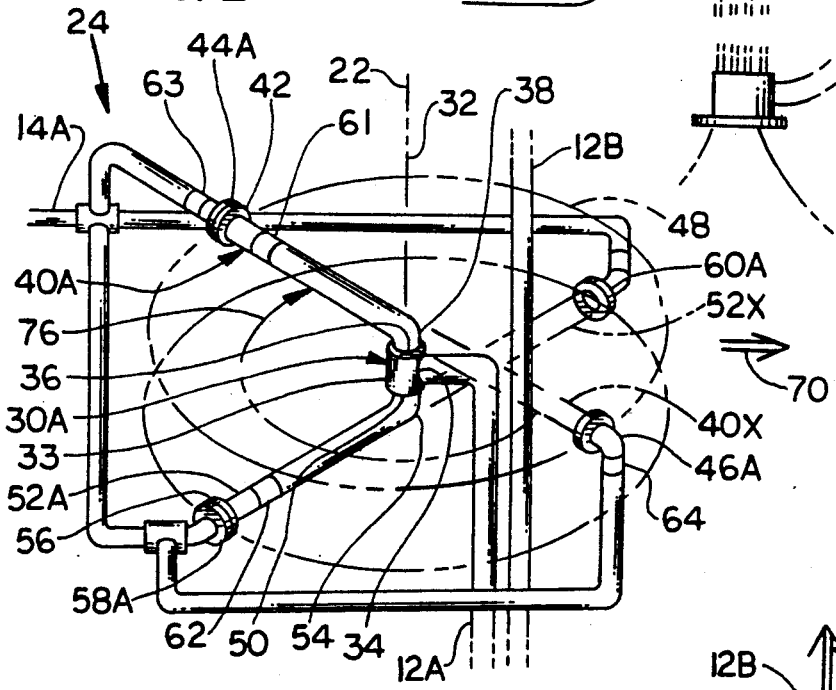
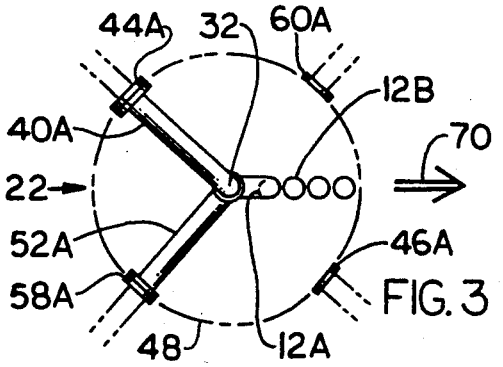
FIG. 3
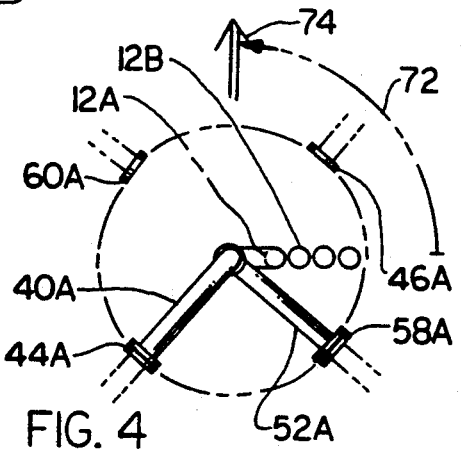
FIG. 4

FIG. 8
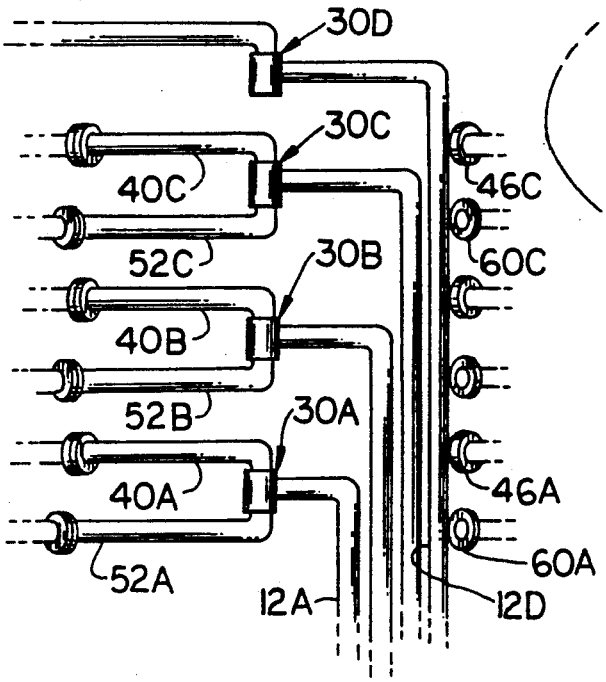
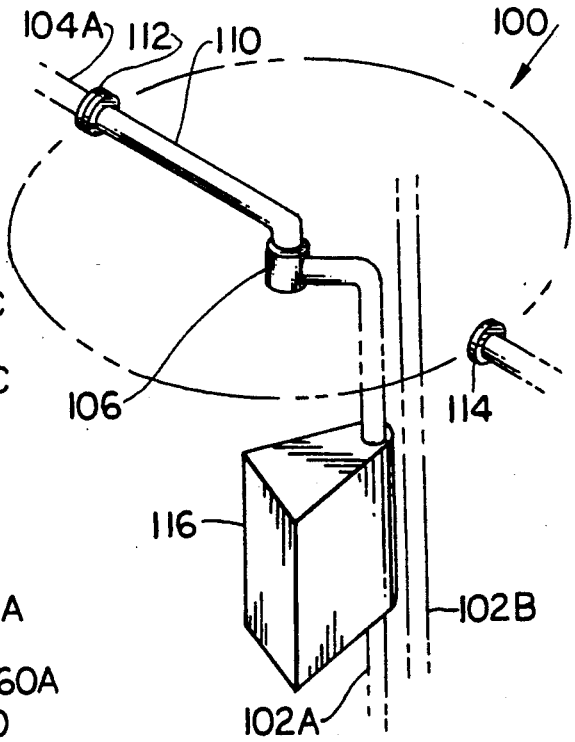
FIG. 9
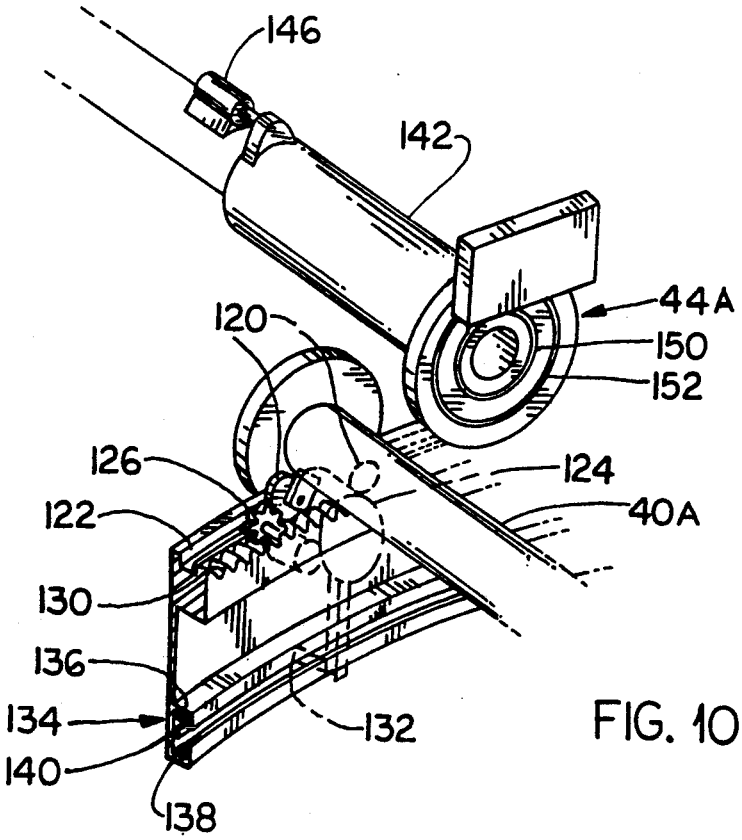
FIG. 10

MULTIPLE FLUID SWIVEL ARRANGEMENT

BACKGROUND OF THE INVENTION

Fluid swivels are commonly used in offshore installations to transfer fluids such as gaseous and liquid hydrocarbons between underwater pipelines or wells and a ship. In many applications, as where oil is produced from several wells or signal and service lines are required, a multipass fluid swivel is required. A common multipass fluid swivel includes several swivels stacked on one another, each including a ring-shaped outer wall that rotates about a ring-shaped inner wall, with a toroidal chamber between them. The inner wall of the lowermost swivels have large diameter central holes through which vertical pipes extend to the upper fluid swivels. As a result, the lower fluid swivels require toroidal chambers of large diameter, and correspondingly large diameter seals. Largely because of the need for large diameter lower swivels, common multipass fluid swivels are of large diameter, large weight, and large cost. For example, a common four to eight pass swivel for high pressure fluids (e.g. up to 6,000 psi) for coupling pipes having inside diameters of up to two feet, may weigh up to 200 tons and cost several million dollars. If one of the seals leaks and must be replaced, the stack of swivels must be torn apart, which leads to long and costly delays. In fact, some multipass swivels include extra swivels for use in the event of a seal failure, with the extra swivels resulting in an even larger multipass swivel.

Various attempts have been made to avoid the disadvantages of currently used multipass fluid swivels. One approach has been to use flexible pipes that are wound on and off of spools as the ship weathervanes. U.S. Pat. No. 4,915,416 by Barrett shows one example of this approach. In practice, so called "flexible" hoses are not very flexible, and must be wrapped on large diameter spools, all resulting in large diameter and costly swivels. Another approach which is described in Norwegian patent 885,306 by Paasche et al uses pairs of long flexible hoses extending from each pipe on the ship, with the hose ends being detachably connected to couplings on a nonrotatable turret that is anchored to the sea floor. Where high pressure hydrocarbons must be carried, available flexible hoses are not very flexible, so they must be long to obtain moderate flexing. The long moving hoses require a lot of room and are costly. A multipass fluid swivel arrangement which used fluid swivels of moderate diameter and enabled ready access to the different fluid swivels for maintenance and repairs, as in the event of leaking seals, would be of considerable value.

SUMMARY OF THE INVENTION

In accordance with one embodiment of the present invention, a fluid swivel apparatus is provided for coupling a largely stationary pipe extending up from an underwater location, to a rotatable pipe on a ship that can weathervane. The fluid swivel has a largely vertical pivot axis, and includes a fluid-carrying arm with an inner end that can rotate about the pivot axis and with an outer end. At least two fluid couplings are mounted on the ship and arranged along a circle so at least one coupling always lies adjacent to the outer end of the arm. The outer end of the arm is detachably connectable to the couplings. When the ship has weathervaned so the pivoting arm is approaching a position of interference, the outer end of the arm is detached from a first coupling, the arm is pivoted into alignment with a second coupling, and the outer end of the arm is attached to the second coupling to flow fluid through it.

Two pivoting arms can be attached to the fluid swivel, so that while the first arm is being detached and pivoted to another position, fluid can continue to flow through the second arm. In another arrangement, an accumulator is provided along the stationary pipe, to receive fluid during the time when the arm is disconnected and pivoted to another position, so that flow from an undersea well continues uninterrupted. In an arrangement where the fluid swivel must be spaced from the axis of rotation of a turret to which the fluid swivel and stationary pipe are attached, the arm can include two pivotally connected links.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial side elevation view of a fluid transfer installation constructed in accordance with one embodiment of the present invention.

FIG. 2 is a simplified isometric view of a portion of the multipass fluid swivel of FIG. 1.

FIG. 3 is a plan view of the swivel of FIG. 2, with the ship heading in a particular direction.

FIG. 4 is a view similar to that of FIG. 3, but after the ship has pivoted 90° counter clockwise.

FIG. 8 is a side elevation view of the fluid swivel of FIG. 7.

FIG. 9 is a simplified isometric view of a fluid swivel apparatus constructed in accordance with another embodiment of the invention, which includes an accumulator.

FIG. 10 is a partial isometric view of mechanisms of the fluid swivel of FIG. 2, showing the arm approaching a position in alignment with a fluid coupling.

DESCRIPTION OF THE PREFERRED EMBODIMENTS

Figure 5:
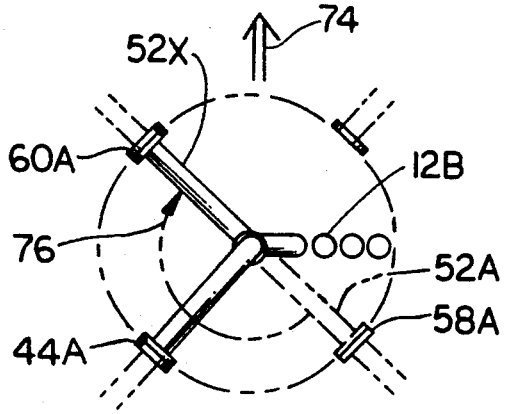
FIG. 5 is a view similar to that of FIG. 4, but after one arm has been turned 180°.

FIG. 1 illustrates a fluid transfer system 10 wherein fluids such as gaseous and liquid hydrocarbons from undersea wells are transferred through a group of substantially stationary pipes 12 to a group of rotatable pipes 14 leading to the hull of a ship 16. The flow direction can be in the reverse direction, as in the case of subsea well injection or service, or unloading of a tanker. The upper portions of the stationary pipes 12 extend along quiescent substantially vertical positions, although they may tilt from the vertical, rotate and move sidewardly, but all in limited amounts. The ship 16, on the other hand may weathervane, wherein the ship turns about a vertical axis 22 in accordance with changing winds, waves, and currents. A multipass fluid swivel apparatus 24 is mounted on a substantially stationary turret 26 that can remain substantially stationary while the ship weathervanes about it.

FIG. 2 illustrates a portion of the fluid swivel apparatus 24 which connects a stationary first pipe 12A which extends from a deep underwater location, to a rotatable first pipe 14A that rotates about the vertical axis 22 with the weathervaning ship. The apparatus includes a first fluid swivel 30A whose pivot axis 32 is coincident with the pivot axis 22 of the turret. The swivel has a body 33 with a first port 34 connected to the stationary first pipe 12A. The swivel has a second port 36 connected to the inner end 38 of a first arm 40A. The inner end 38 of the first arm extends along the pivot axis 32 and allows the arm 40A to pivot about the axis 32. The radially outer end 42 of the arm, which lies furthest from the swivel axis 32, is connected to a first fluid coupling 44A. The fluid coupling 44A connects to the rotatable first pipe 14A.

The apparatus includes a second stationary pipe 12B which extends beside the first pipe 12A but extends to a greater height than the first pipe. When the ship turns far enough that the arm 40A approaches the second pipe 12B, there is danger that further ship rotation could cause interference of the arm with the second pipe, leading to damage to one of them. To prevent such interference, the outer end of the arm 40A is disconnected from the first coupling 44A, and the arm is pivoted 180° to the position 40x wherein the outer end of the arm is aligned with a second fluid coupling 46A. The outer end of the arm 40x is then connected to the second coupling 46A which is connected to the rotatable first pipe 14A. The couplings 44A, 46A are located on an imaginary circle 48 whose center lies on axis 32. Thus, the simple fluid swivel 30A with the pivotable arm 40A thereon which can connect to either one of two fluid couplings 44A, 46A, enables the fluid swivel 30A to be always connected to the rotatable pipe 14A on the ship, except for brief interruption periods. These brief periods are the periods of time that it takes to disconnect the end of the arm 40A from one coupling, and rotate the arm into alignment with the other coupling and connect it thereto.

In most applications, it is highly desirable to maintain a continuous flow of fluid through the stationary pipe 12A. That is, it is desirable to avoid an interruption of fluid flow through the pipe, during a period of perhaps a minute that it takes to disconnect the first arm 40A from one coupling, rotate the arm, and reconnect it to another coupling. To avoid such interruption, the fluid swivel 30A is provided with a third port 50 and a second arm 52A that is connected to the downwardly-opening third port 50, with the inner end 54 of the arm 52A being pivotable about the pivot axis 32 of the swivel. The second arm 52A has an outer end 56 which connects to a first lower coupling 58A. During the time when the first or upper arm 40A is pivoted from the position 40A to the position 40x, flow through the pipe 12A can continue by passing the fluid through the swivel 30A by way of the second arm 52A and the fluid coupling 58A to the rotatable pipe 14A.

As the ship weathervanes, it can pivot to a position wherein the second arm 52A is in danger of interference with the pipes 12A, 12B. To avoid such interference, the outer end of the second arm 52A is disconnected from the coupling 58A, rotated 180° to the position 52x, and connected to a second fluid coupling 60A. Thus, by using two pivoting arms, applicant is able to maintain continuous fluid flow through the stationary and rotatable pipes while the ship weathervanes. Shutoff valves such as 61–64 are provided along each arm and coupling, to stop the loss of fluid when that arm or coupling is not connected to a corresponding coupling or arm.

FIGS. 3–6 illustrate how the fluid swivel 22 is operated as the ship weathervanes. FIG. 3 shows the fluid swivel in the orientation shown in solid lines in FIG. 2, with the ship heading in the direction 70 and with the fluid swivel arms 40A, 52A connected to the fluid couplings 44A, 58A. The other fluid couplings 46A and 60A are unconnected.

FIG. 4 shows the arrangement after the ship has pivoted 90° counter clockwise as indicated by arrow 72, so the ship is now heading in the direction indicated by arrow 74. The arms 40A, 52A continue to be connected to the couplings 44A, 58A. However, in FIG. 4 the arm 52A has turned far enough that it is in danger of interference with the first stationary pipe 12A if there was any further counter clockwise rotation of the ship. To prevent this, the arm 52A is rotated clockwise, as indicated in FIG. 5 by arrow 76. The arm which was originally at 52A has been rotated 180° to the position 52x, and has been connected with the fluid coupling 60A. This avoids interference between either of the arms and the stationary pipes such as 12B.

Figure 6:
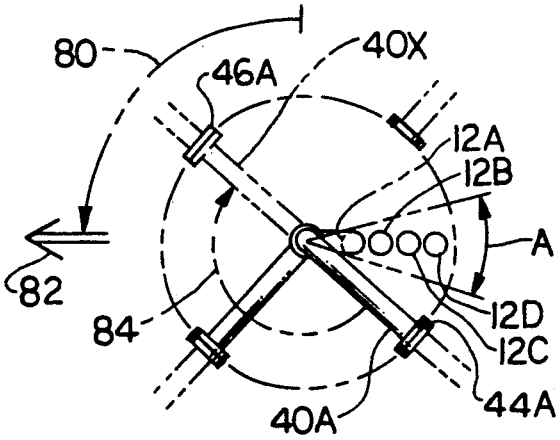
FIG. 6 is a view similar to that of FIG. 5, but after the ship has turned counter clockwise by another 90°.

FIG. 6 shows the fluid swivel after the ship has rotated another 90° indicated by arrow 80, so the ship is heading in the direction indicated by arrow 82. At this time, the upper arm 40A is approaching a position of interference with the pipe 12B. To avoid this, the arm 40A can be disconnected from coupling 44A, rotated 180° in the direction of arrow 84 to the position 40x, and connected to the coupling 46A. The rotation of the pipes by 180° can be accomplished in both clockwise and counter clockwise directions, to permit continuous fluid flow throughout unlimited weathervaning of the ship. Of course, more than two couplings can be provided for each pivotable arm.

Figure 7:
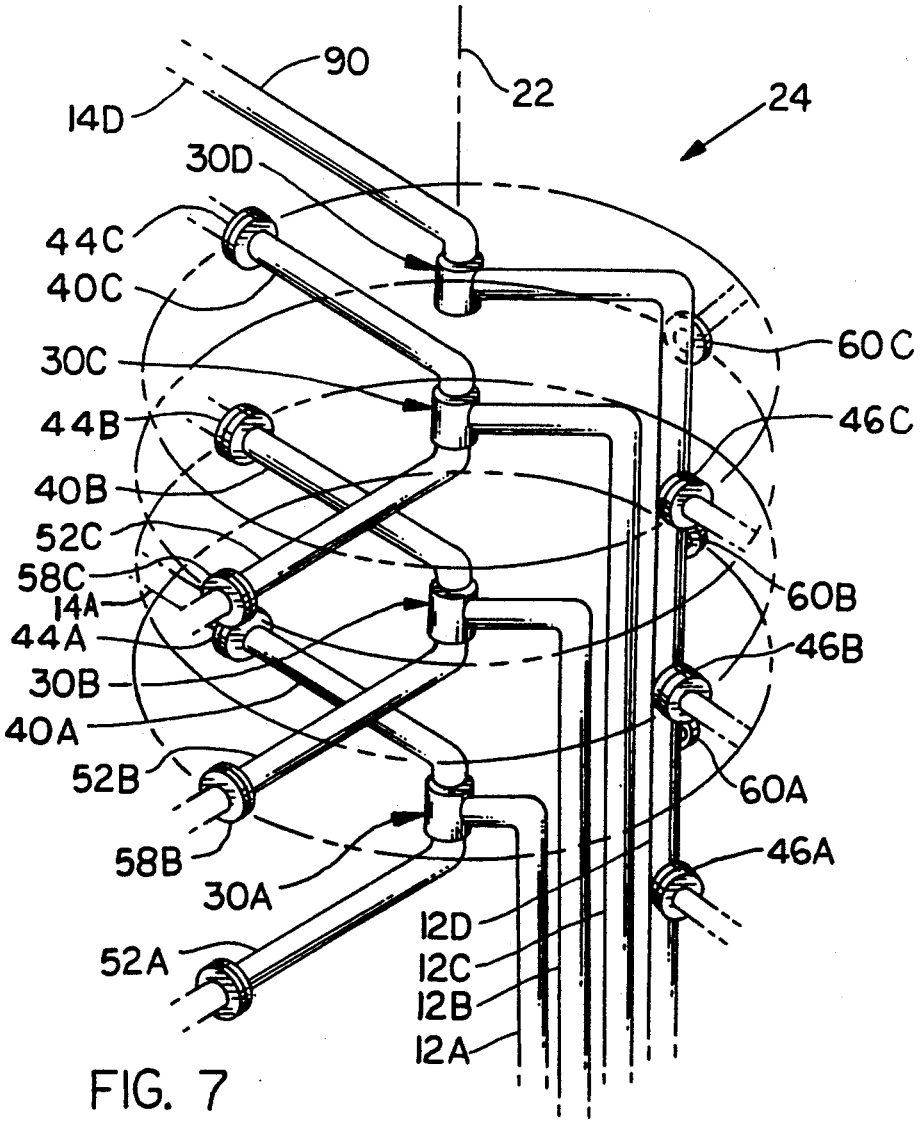
FIG. 7 is a more complete isometric view of the fluid swivel of FIG. 2.

FIGS. 7 and 8 are more complete views of the multipass fluid swivel apparatus 24, which includes the first fluid swivel 30A which connects the first stationary pipe 12A to a pair of first arms 40A, 52A. The apparatus includes three additional fluid swivels 30B, 30C and 30D which connect to three other stationary pipes 12B, 12C and 12D. The fluid swivels 30B and 30C are similar to the first one 30A. That is, the second swivel 30B includes a pair of substantially rigid pivoting arms 40B, 52B that have pivot axes coincident with the axis 22 of the turret. Also, each upper arm 40B, 40C is detachably connectable to either one of two upper fluid couplings 44B, 44C or 46B, 46C. Similarly, the lower arms 52B, 52C are connectable to either one of two couplings 58B, 58C or 60B, 60C. All couplings lie substantially on the imaginary circle 48 as seen in a plan view of the apparatus. The uppermost swivel 30D includes a single fluid-carrying arm 90 which is substantially permanently connected to a stationary pipe 14D. This is possible for the uppermost swivel 30D, because there is no stationary vertical pipe extending to the same level or higher than the level of the arm 90.

FIG. 9 illustrates another fluid swivel apparatus 100 that provides a connection between a stationary pipe 102A and a rotatable pipe 104A, and which includes a fluid swivel 106 having a single rotatable arm 110. When the ship to which the rotatable pipe 104A is attached, rotates so that the arm 110 is in danger of interference with the pipe 102B, the outer end of the arm must be disconnected from the coupling 112. During the time that it takes for the arm 110 to be rotated 180° into alignment with another coupling 114 connected thereto, there is no flow through the rotatable pipe 104A. However, flow through the stationary pipe 102A can continue, because an accumulator 116 is connected to the pipe 102A. Accumulators are well known devices that will store a limited amount of fluid, the accumulator allowing fluid to continue to flow through the pipe 102A up to the accumulator. The accumulator can be a simple storage tank and a device for flowing fluid back into the pipe once connection is reestablished. In some cases, the flow can be stopped, and an accumulator is not required.

After the arm 110 has been rotated and connected to another coupling, the accumulator 116 slowly expels the fluid that has been accumulated in it. A wide variety of accumulators are available, including those with a piston that moves along a cylinder to store additional fluid in the cylinder when the pressure applied to one side of the piston increases beyond a predetermined level, the piston being biased in the opposite direction to expel fluid when the pressure drops below the predetermined level. Other accumulators are available that can be switched between storage and depletion modes at given times.

Figure 11:
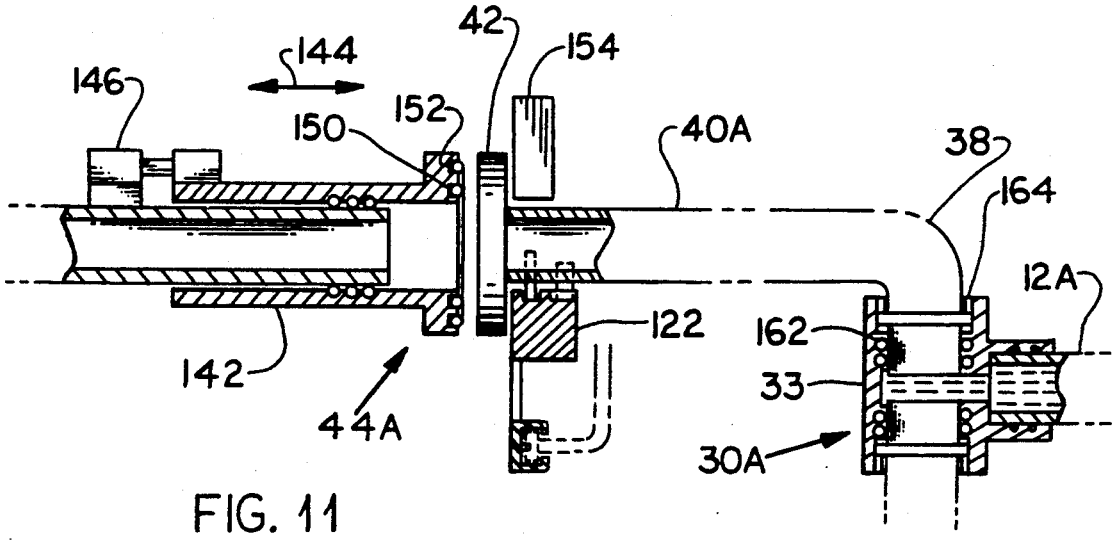
FIG. 11 is a partially sectional side view of the apparatus of FIG. 10, with the arm in alignment with the coupling but not yet attached thereto.

FIGS. 10 and 11 illustrate mechanisms for rotating the arm 40A (earlier discussed in connection with FIG. 2) into alignment with a coupling 44A and attaching them together. A pair of rollers 120 (FIG. 10) are mounted on the arm 40A and support the arm on a circular track 122 that is mounted on the ship and rotates with it. A motor 124 attached to the arm drives a gear 126 that is engaged with a toothed rack 130 that extends along the track 122. Thus, when the motor is energized to turn the gear 126, the outer end of the arm is moved along the circular track, so that it can be moved into alignment with the coupling 44A. A brush set 132 depending from the motor, is engaged with a power and control track 134 that extends parallel to the support track 122. The power track 134 has a pair of low voltage (e.g. 24 volts) conductors 136, 138 that carry power to the motor, and also has one or more control conductors 140 that carry control signals to the motor and that can carry signals from sensors (not shown) on the arm.

When the arm is pivoted to a position aligned with the coupling 44A, as shown in FIG. 11, the coupling is operated to complete the connection. The coupling 44A includes an extendable coupling part 142 that can be moved in the direction of arrows 144 by an actuator 146 (that may be hydraulic or electrical). When the actuator moves the exterior coupling part 142 towards the outer arm end 42, a pair of O-rings 150, 152 form a fluid tight seal against a flange at the arm outer end 42. A fortified location along the tract 122 and a backup block 154 can be provided to withstand the force on the arm outer end. An extendable and retractable pipe end is manufactured by the Vetco Company.

The use of a relatively simple fluid swivel 30A provides ready access to the body 33 of the fluid swivel. If seals such as 162 become defective, a workman can remove a lock ring 164 to remove the inner end 38 of the arm from the body 33, replace the damaged seal 162, reinsert the arm end 38, and refasten the lock ring 164. Ready access to any one of the bodies of the fluid swivels and the arms thereof makes repair much easier than heretofore. In fact, a spare fluid swivel body, arm, and fluid coupling can be provided, since all of these parts can be identical for other identically sized lower fluid swivels of the apparatus. The body 33 and seals 162 of all fluid swivels are of relatively small diameter. For example, for a flow line of a diameter of one foot, the body 33 of the fluid swivel and the seals 162 need have a diameter of no more than about one and one half feet. This can be compared to prior art multipass fluid swivels, where the need to provide a large diameter hole in the fluid swivel for passing several pipes, can result in the need for seals of several feet diameter lying in inaccessible areas. The fluid swivels can be configured to allow pigs (cleaning vehicles) to pass through at least one arm of the swivel.

Figure 12:
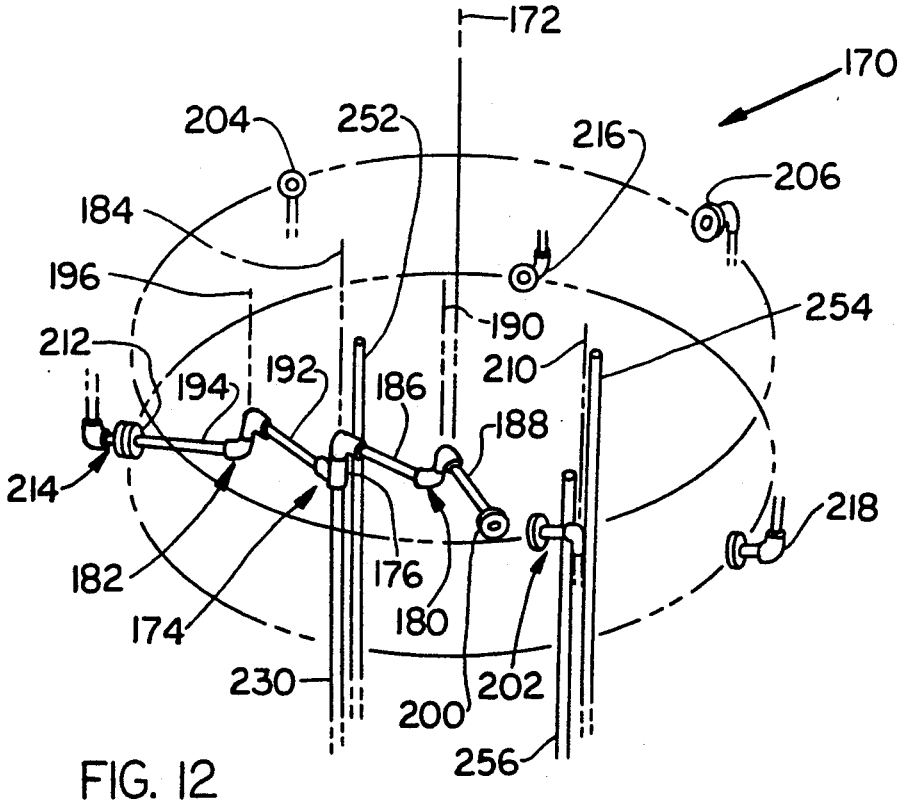
FIG. 12 is a partial isometric view of a fluid swivel constructed in accordance with another embodiment of the invention.
Figure 13:
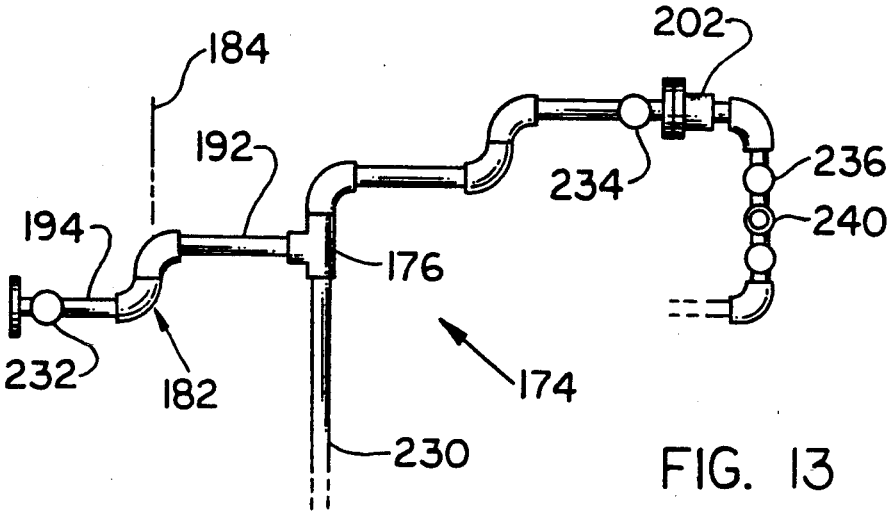
FIG. 13 is a partial side elevation view of the fluid swivel of FIG. 12.
Figure 14:
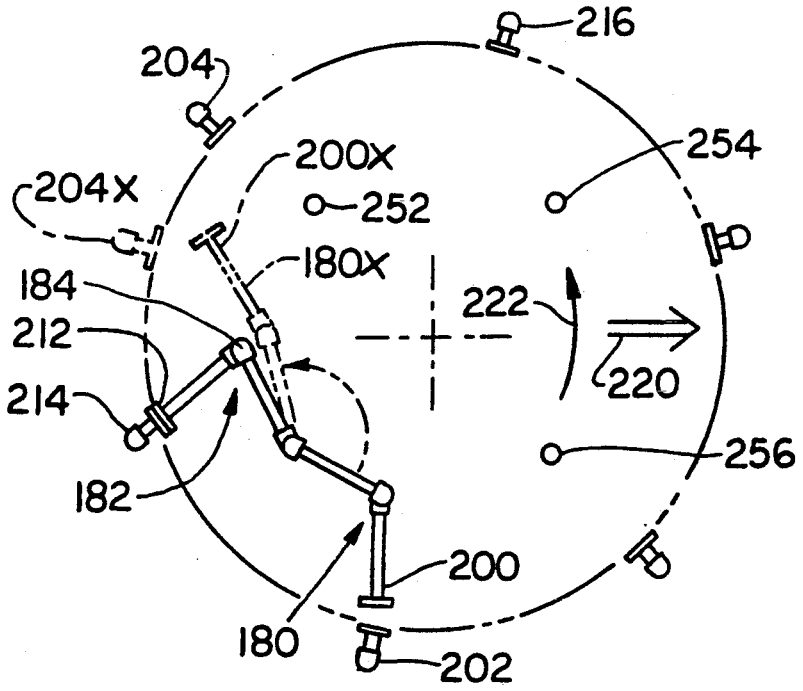
FIG. 14 is a plan view of the fluid swivel of FIG. 12.

The above described fluid swivel apparatus uses rotatable arms that pivot on an axis coincident with the axis of the turntable with respect to the ship. In many situations, it is highly desirable to leave a region at and around the turret axis free for workover and drilling. FIGS. 12–14 illustrate another fluid swivel arrangement 170 that leaves an area at and around the turret pivot axis 172 (FIG. 12) free for other operations. The apparatus includes several fluid swivels, with one of the swivels 174 shown in some detail. The swivel 174 includes a body 176 connected to a stationary pipe 230, and upper and lower arms 180, 182 extending from the body.

The inner ends of the arm are pivotally connected to the body 176 about an axis 184. The upper arm has a pair of fluid-carrying links 186, 188 that are pivotally connected together about an upper arm axis 190. The lower arm 182 includes a pair of fluid-carrying links 192, 194 that are pivotally connected about a lower arm axis 196. The use of two pivotally connected links at each arm, permits changing of the distance between the inner end of the arm that is attached to the body 176, and the outer end of the arm that can be attached to a fluid coupling.

The outer end 200 of the upper arm can be detachably connected to any one of three upper couplings 202, 204, and 206 that are spaced about a circle. Each coupling such as 202 is pivotally mounted about an axis 210 to permit the end of the coupling to face in a range of horizontal directions. Similarly, the outer end 212 of the lower arm is detachably connectable to any of three lower couplings 214, 216 and 218 whose outer ends can pivot in the same manner as the upper couplings.

FIG. 14 illustrates the fluid swivel apparatus in a position wherein the outer end 212 of the lower arm 182 is connected to coupling 214. However, the upper arm 180 is positioned so its outer end 200 is spaced from the coupling 202, from which it has been recently detached. If the ship rotates in the counter clockwise direction indicated by arrow 222, then the upper coupling 204 will move to the position 204x. The arm 180 can be pivoted about 180° to the position 180x, wherein its outer end at 200x can be attached to the upper coupling at 204x. After further counter clockwise rotation of the vessel, the lower arm 182 will have to be similarly detached from one coupling 214, pivoted, and attached to another one 216.

FIG. 13 illustrates some details of the fluid swivel 174. It can be seen that valves 232, 234 are provided near the outer end of each arm to stop flow through that arm immediately before disconnection from a coupling such as 202. Also, the coupling such as 202 is coupled through a valve 236 to a gathering pipe 240 to which all upper and lower couplings for that fluid swivel, are connected, and which leads to a single rotatable pipe on the ship. Additional fluid swivels similar to the swivel 174 can be located at the same level or a different level than the fluid swivel 174 to connect.. each of the other three stationary pipes 252, 254, 256 (FIG. 14) to corresponding rotatable pipes on the ship. Each of the arms such as 182 is preferably rigid along most of its length, with flexibility provided only at the axis 184 where the two links are pivotally joined (and possibly also at any pivoting end of the link 194). This enables arms of relatively short length to be used, as compared to available "flexible" hoses which are not very flexible so they must be long and are costly, and their middles can move around in difficult-to-predict ways.

Figure 15:
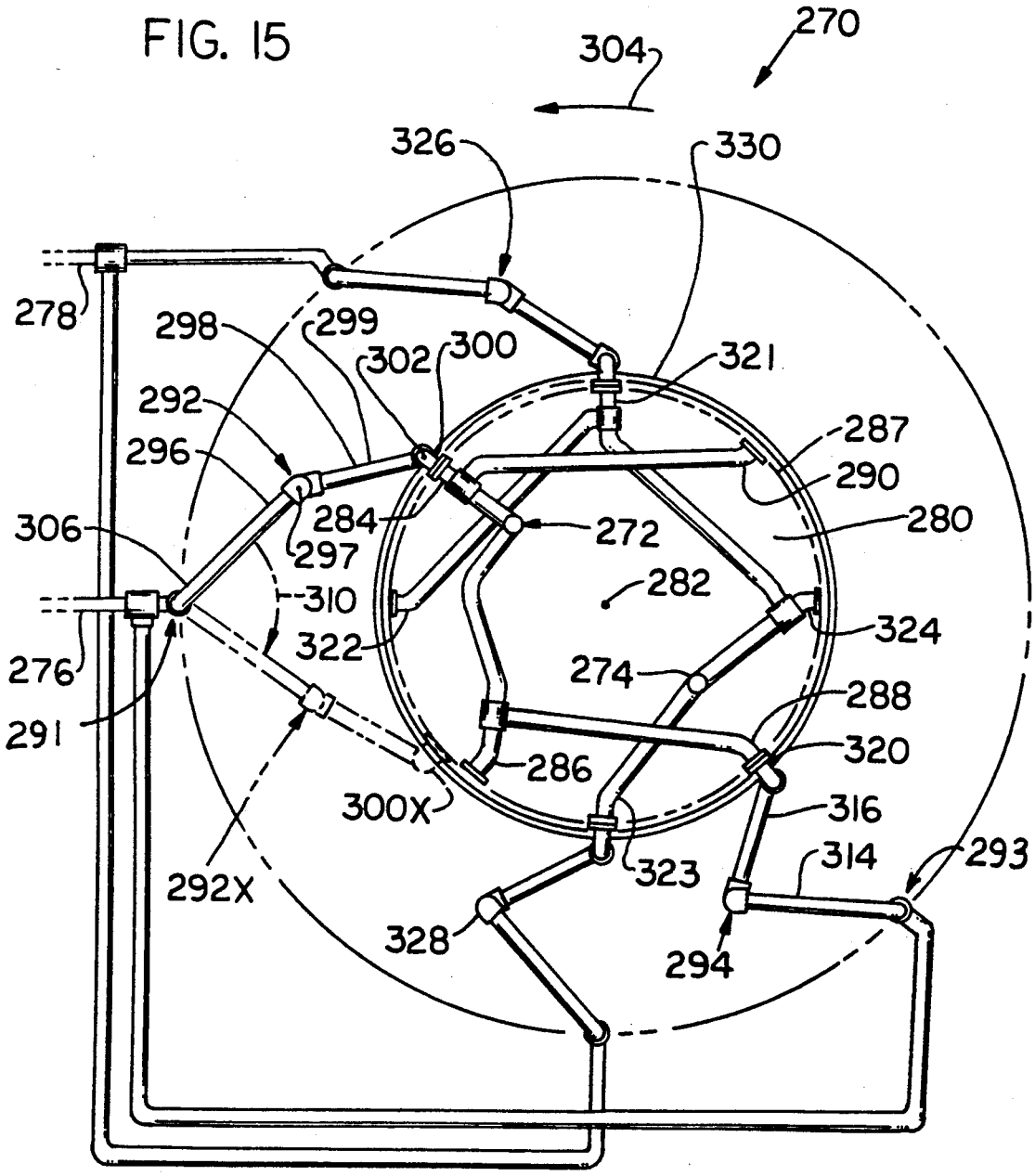
FIG. 15 is a plan view of a fluid swivel constructed in accordance with another embodiment of the invention.

FIG. 15 illustrates another fluid swivel apparatus 270 which connects each of two stationary pipes 272, 274 to corresponding rotatable pipes 276, 278 lying on a weathervaning ship. The stationary pipes 272, 274 are mounted on a substantially stationary turret 280 which has an axis of rotation 282, with the ship rotating about the turret about the axis 282. The area about the turret axis 282 is unobstructed, as in the case of the apparatus of FIGS. 12–14. However, this apparatus uses pivoting arms (e.g. 292) whose inner ends are mounted on the ship, and uses couplings (e.g. 284) that are mounted on the nonrotating turret.

The stationary pipe 272 is connected to four couplings 284, 286, 288, and 290 that are spaced about an imaginary circle 287 that is coincident with the turret axis 282. The rotatable pipe 276 which is to be coupled to the stationary pipe 272, is connected to two swivels 291, 293 that each includes a pivotal arm 292, 294. The arm 292 includes two fluid-carrying rigid links 296, 298 pivotally joined at axis 297, with link 298 having a main portion 299 and a pivoting end 300 that can pivot about an axis 302 on the main portion of the link. If the ship should turn in the counter clockwise direction indicated by arrow 304, then the distance between opposite ends 300, 306 of the arm 292 will increase. To prevent damage to the arm or couplings, the outer end 300 of the arm will be disconnected from the coupling 284. The arm will then be pivoted as indicated by arrow 310, until the arm is in the position indicated at 292*x*. With the ship rotated slightly, the end 300*x* of the arm will be aligned with the coupling 286 and can connect to it. During disconnection of the arm from coupling 284 and its reconnection to coupling 286, hydrocarbons can continue to flow through arm 294. The arm 294 is of similar construction to that of the arm 292, with the arm 294 having a pair of pivotally connected links 314, 316 and a pivotally connected outer end 320. The outer end 320 is connected to a coupling 288.

The other stationary pipe 274 is connected to four couplings 321–324 that are arranged on the same circle 287, as seen in a plan view. A pair of arms 326, 328 can each connect to a corresponding one of the couplings 321–324, and can "step around" the circle of coupling 321–324 as the ship rotates, or weathervanes. Additional stationary pipes can be connected to additional couplings arranged along the same circle 287 or higher or lower circles, to be connected to additional pairs of arms. All of the arm outer ends such as 300, 320 can be mounted to slide around a circular guideway 330. Furthermore, the outer ends of two arms such as 292, 326 can be moved in synchronism by the same apparatus, while the outer ends of two other arms such as 294, 328 also can be moved in synchronism by a single moving apparatus. The two sets of couplings 284–290 and 321–324 can lie at the same height. Each of the arms such as 292 is preferably rigid along most of its length, with flexibility only at axes 297 and 302, for the reasons given above in connection with FIG. 13.

It may be noted that toroidal fluid swivels may be used for hydraulic lines and for other fluids, in addition to the nontoroidal swivels described above. Also, a mix of on center (e.g. FIG. 7) and off center (e.g. FIG. 12) swivels can be used in one installation.

Thus, the invention provides a fluid swivel for coupling a largely stationary first pipe extending up from an underwater location, to a rotatable pipe on a ship, buoy, or other rotatable structure (all of which can be referred to as a "ship") floating on the sea surface and which can weathervane, which facilitates maintenance of the fluid swivel. The fluid swivel generally connects a first one of a plurality of largely vertical stationary pipes. The fluid swivel can include a body with a first port connected to one of the pipes and a second port coupled to an arm that is preferably rigid along most of its length and extends largely horizontally and that can pivot about the pivot axis of the swivel. An outer end of the arm is detachably connectable to one of a plurality of fluid couplings that are arranged along a circle that is coincident with the pivot axis of the ship with respect to a turret on which the stationary pipes are mounted. As the ship turns, the arm can approach a position of interference wherein the arm is in danger of hitting a stationary pipe, or of having its opposite ends pulled too far apart. The arm is detached from one of the fluid couplings, pivoted, and later attached to another of the couplings. A complete multipass fluid swivel arrangement generally includes a plurality of such fluid swivels. Although the arrangement has additional complexities as compared to conventional multipass fluid swivels, in that it requires detaching the arm from one coupling, pivoting the arm into alignment with another coupling, and attaching the arm to the other coupling, the arrangement has many advantages. An important advantage is that each of the fluid swivels can be of relatively small diameter, since the swivel does not require a wide central hole for passing pipes. Also, each fluid swivel is readily accessible for maintenance and repairs.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A fluid transfer installation comprising:

a ship which can weathervane and which has a plurality of rotatable pipes that weathervane with the ship, said ship having a turret and said ship being rotatable about a substantially vertical turret axis relative to said turret so said turret can avoid large rotation about a vertical turret axis as said ship weathervanes;

a plurality of stationary pipes with substantially nonrotatable upper portions that are mounted to said turret;

a plurality of fluid swivels that each couples one of said stationary pipe portions to one of said rotatable pipes;

a first of said fluid swivels includes a largely horizontally-extending elongated arm with an inner end pivotally coupled to a first of said stationary pipes to enable rotation of said arm about a primarily vertically-extending swivel axis relative to said first stationary pipe, said arm having an outer end spaced from said swivel axis;

a plurality of couplings arranged substantially along an imaginary circle centered on said turret axis as seen in a plan view, said arm outer end being detachably connectable to each of said couplings, and each of said couplings being connected to one of said rotatable pipes.

2. The installation described in claim 1 wherein:

said plurality of swivels are of similar construction, and each has a swivel axis that is substantially coincident with said turret axis, with said swivels being vertically spaced apart.

3. The installation described in claim 1 wherein:

said plurality of swivels are of similar construction, and each has a swivel axis that is spaced from said turret axis;

each swivel has an arm with a pair of pivotally connected fluid-passing rigid links.

4. A fluid transfer installation comprising:

a ship which can weathervane and which has a plurality of rotatable pipes that weathervane with the ship, said ship having a turret and said ship can rotate about a substantially vertical turret axis relative to said turret;

a plurality of stationary pipes with substantially nonrotatable upper portions that are mounted to said turret;

a plurality of fluid swivels that each couples one of said stationary pipe portions to one of said rotatable pipes;

a first of said fluid swivels includes a largely horizontally-extending arm with an inner end pivotally coupled to a first of said rotatable pipes about a primarily vertically-extending swivel axis, said arm having an outer end spaced from said swivel axis, said arm including a pair of fluid-carrying rigid links that are pivotally connected, with a first of said links forming a majority of the length of said arm inner end and a second of said links forming a majority of the length of said arm outer end;

a plurality of couplings arranged substantially along an imaginary circle centered on said turret axis, said arm outer end being detachably connectable to each of said couplings, and each of said couplings being connected to one of said stationary pipe upper portions.

5. The installation described in claim 4 wherein:

said second link includes a main part and a pivotable fluid coupling connecting said main part to said outer end.

6. A fluid transfer installation comprising:

a ship which can weathervane and which has a plurality of rotatable pipes that weathervane with the ship, said ship having a turret and said ship can rotate about a substantially vertical turret axis relative to said turret;

a plurality of stationary pipes with substantially nonrotatable upper portions that are mounted to said turret;

a plurality of fluid swivel devices that each couples one of said stationary pipe portions to one of said rotatable pipes;

a first of said fluid swivel devices includes an arm having an inner end mounted on a first of said nonrotatable pipes and an opposite outer end, said arm being capable of flexing so said outer end can move;

a plurality of couplings arranged largely along an imaginary circle centered on said turret axis, said arm outer end being detachably connectable to each of said couplings, and each of said couplings being connected to one of said rotatable pipes.

7. The installation described in claim 6 wherein said arm includes a pair of fluid-carrying rigid links that are pivotally connected.

8. A method for flowing fluid between a substantially nonrotatable pipe extending from an undersea location, and a rotatable pipe that is mounted on a ship or the like that weathervanes, comprising;

flowing said fluid through a first of said pipes, along a substantially vertical pivot axis of a fluid swivel, through a first pivot arm extending largely radially away from said pivot axis, between a radially outer end of said arm and a first of a plurality of detachable couplings, and from said first coupling through a second of said pipes;

detaching said arm outer end from said first coupling, pivoting said arm about said pivot axis into a position adjacent to a second of said couplings that is also connected to said second of said pipes, and attaching said arm outer end to said second coupling.

9. The method described in claim 8 including:

during the period between said step of detaching said first arm outer end from said first coupling and attaching said first arm outer end to said second coupling, flowing said fluid through said first pipe and along said pivot axis through a second pivot arm extending largely radial to said pivot axis and through a third of said couplings and said second pipe.

10. The method described in claim 8 including:

during the period between said step of detaching said first arm outer end from said first coupling and attaching said first arm outer end to said second coupling, flowing said fluid through one said pipes into an accumulator.

11. A fluid swivel apparatus which couples each of a group of largely stationary pipes extending up from undersea locations, to each of a group of rotatable pipes mounted on a ship or the like that can weathervane, characterized by:

a first fluid swivel with a body connected to a first pipe of one of said groups of pipes, said first swivel having first and second largely horizontally-extending fluid-carrying arms each having an inner end pivotally mounted on said body about a primarily vertically-extending swivel axis, and each of said arms having an outer end spaced from said axis;

a plurality of first couplings each connected to a first pipe of the other of said groups of pipes, said first couplings being arranged largely along an imaginary circle as seen in a plan view, said first arm outer ends being detachably connectable to each of said first couplings;

a plurality of second couplings each connected to a second pipe of said other of said groups of pipes, said second couplings being arranged largely along a second imaginary circle, and said second arm outer ends being detachable connectable to each of said second couplings;

said body has a first port connected to said first pipe of said one of said groups, and second and third ports that face vertically with one facing primarily up and the other facing primarily down, said first arm inner end lying on and extending upwardly along said pivot axis, and said second arm inner end lying on and extending downwardly along said pivot axis, and said first arm and first plurality of couplings lie above the level of said second arm and second plurality of couplings.

12. A fluid swivel apparatus which couples each of a group of largely stationary pipes extending up from undersea locations, to each of a group of rotatable pipes mounted on a ship or the like that can weathervane, characterized by:

a first fluid swivel with a body connected to a first pipe of one of said groups of pipes, said first swivel having a largely horizontally-extending fluid-carrying arm with an inner end pivotally mounted on said body about a primarily vertically-extending swivel axis, said arm having an outer end spaced from said axis;

a plurality of first couplings each connected to a first pipe of the other of said groups of pipes, said couplings being arranged largely along an imaginary circle as seen in a plan view, said arm outer end being detachably connectable to each of said couplings;

one of said first pipes is arranged to flow fluid in a direction toward and through said first fluid swivel into the other first pipe; and including an accumulator connected to said one of said pipes, whereby to accumulate fluid flowing into said one of said pipes during the time between disconnection of said arm end from one of said couplings and connection of said arm end to another of said couplings.

13. A fluid swivel apparatus which couples each of a group of largely stationary pipes extending up from undersea locations, to each of a group of rotatable pipes mounted on a ship or the like that can weathervane, characterized by:

a first fluid swivel with a body connected to a first pipe of one of said groups of pipes, said first swivel having a largely horizontally-extending fluid-carrying arm with an inner end pivotally mounted on said body about a primarily vertically-extending swivel axis, said arm having an outer end spaced from said axis, and said arm comprising at least one rigid pipe with most of the length of said arm being rigid;

a plurality of first couplings each connected to a first pipe of the other of said groups of pipes, said couplings being arranged largely along an imaginary circle as seen in a plan view, said arm outer end being detachably connectable to each of said couplings.

14. The apparatus described in claim 13 wherein:

said fluid swivel has a second fluid-carrying arm with an inner end mounted on said body, said second arm being pivotable about said axis and having an outer end lying furthest from said swivel axis;

a second plurality of fluid couplings arranged largely along a second circle;

said outer end of said second arm being detachably connectable to said second fluid couplings, whereby when one of said arms must be detached from one of said couplings the other arm can remain attached to another coupling to enable uninterrupted flow between said pipes.

15. The apparatus described in claim 13 wherein:

said one of said groups of pipes is said group of largely stationary pipes; and including a turret pivotally mounted on said ship about a turret axis that is substantially coincident with said pivot axis about which said arm inner end is pivotally mounted on said first pipe of said group of stationary pipes; and wherein said group of stationary pipes includes second and third stationary pipes, in additjon to said first pipes, each having a portion that is substantially fixed to said turret, with said first and second pipes having upper portions extending largely parallel and close to each other, and with said third pipe extending higher than said first and second pipes; and including a second fluid swivel that is substantially identical to said first swivel and which is connected to said second stationary pipe, said second swivel lying above said first swivel, with the pivot axes of said first and second swivels being substantially coincident, and with said second swivel having an arm with an inner end pivotable about said axis and lying above said arm of said first swivel.

16. The apparatus described in claim 13 including:

a turret that is pivotally coupled to said ship about a largely vertical turret axis, said group of stationary pipes being mounted on said turret and said imaginary circle is substantially centered on said turret axis;

said swivel axis is spaced from said turret axis, and said arm includes a pair of pivotally connected fluid-carrying links, each link being rigid along a majority of its length, to enable variation of the distance between said swivel axis and said couplings as said ship weathervanes.

17. The apparatus described in claim 16 including:

a second fluid swivel that has a second body, a largely horizontally-extending second arm with an inner end pivotally mounted on said second body about a second axis that is spaced from both said swivel axis and said turret axis and with an outer end, and with said second arm having a pair of pivotally connected links;

a plurality of second couplings each detachably connectable to said second arm outer end;

said bodies of said first and second fluid swivels each being connected to a different pipe of said group of stationary pipes, and said fluid couplings each connected to a different pipe of said group of rotatable pipes.

18. The apparatus described in claim 16 including:

a second fluid swivel that has a second body, a largely horizontally-extending second arm with an inner end pivotally mounted on said second body about a second axis that is spaced from both said swivel axis and said turret axis and with an outer end, and with said second arm having a pair of pivotally connected links;

a plurality of second couplings each detachably connectable to said second arm outer end;

said bodies of said first and second fluid swivels each being connected to a different pipe of said group of rotatable pipes, and said fluid couplings each connected to a different pipe of said group of stationary pipes.

* * * * *